US006637474B2

(12) United States Patent
Hall

(10) Patent No.: US 6,637,474 B2
(45) Date of Patent: Oct. 28, 2003

(54) PORTABLE LEVEE SYSTEM

(75) Inventor: David K. Hall, Springfield, KY (US)

(73) Assignee: Westwind Levee Systems, LLC, Lebanon, KY (US)

( * ) Notice: Subject to any disclaimer, the term of this patent is extended or adjusted under 35 U.S.C. 154(b) by 0 days.

(21) Appl. No.: 10/145,214

(22) Filed: May 14, 2002

(65) Prior Publication Data

US 2003/0075239 A1 Apr. 24, 2003

Related U.S. Application Data

(63) Continuation-in-part of application No. 09/621,425, filed on Jul. 21, 2000, now Pat. No. 6,390,154.

(51) Int. Cl.[7] ..... B65B 1/04

(52) U.S. Cl. ..... 141/231; 141/313; 141/316; 141/325; 222/608

(58) Field of Search ..... 141/313–317, 141/231–233, 114, 325; 222/608, 613, 619, 620, 626, 628; 383/22, 24, 32, 37, 38, 84, 907; 405/15, 18–21, 107, 110–112, 114–117

(56) References Cited

U.S. PATENT DOCUMENTS

| | | | | |
|---|---|---|---|---|
| 1,418,403 A | | 6/1922 | Smith | |
| 1,475,603 A | | 11/1923 | Sheridan | |
| 1,983,418 A | | 12/1934 | Thurmer | |
| 2,586,557 A | * | 2/1952 | Newbold | 177/162 |
| 2,767,963 A | | 10/1956 | Ringen et al. | |
| 2,813,704 A | | 11/1957 | MacKissic | |
| 3,552,346 A | * | 1/1971 | Garden | 141/72 |
| 3,886,751 A | | 6/1975 | Porraz Jimenez Labora | |
| 4,184,522 A | | 1/1980 | Waite | |
| 4,362,433 A | | 12/1982 | Wagner et al. | |
| 4,650,368 A | | 3/1987 | Bayer | |
| 4,784,520 A | | 11/1988 | Stevens | |
| 5,244,019 A | | 9/1993 | Derby | |
| 5,425,403 A | | 6/1995 | Herrmann | |
| 5,443,102 A | | 8/1995 | Svendsen | |
| 5,509,229 A | | 4/1996 | Thomasson et al. | |
| 5,538,155 A | | 7/1996 | Hoekstra | |
| 5,584,599 A | | 12/1996 | Knittel | |
| 5,771,665 A | | 6/1998 | Nelson et al. | |
| 5,894,871 A | | 4/1999 | Greer | |
| 5,901,762 A | | 5/1999 | Rollins | |
| 5,971,661 A | | 10/1999 | Johnson et al. | |
| 5,988,237 A | | 11/1999 | Bedsole | |
| 6,126,362 A | | 10/2000 | Carter et al. | |

* cited by examiner

*Primary Examiner*—J. Casimer Jacyna
(74) *Attorney, Agent, or Firm*—John F. Salazar; Middleton Reutlinger

(57) ABSTRACT

A portable levee system including a substantially U-shaped lower frame having a hopper truss extending from said lower frame, a hopper support frame slidably connected to vertical hopper support members depending from the hopper truss. A hopper is positioned in the hopper support frame and a bag rail depends from the hopper support frame and beneath the hopper. The hopper frame may be adjustable manually by rack and pinion, by a hydraulic system, or by other mechanical means. The bag rail may have a plurality of bag guides disposed therein for quickly and easily positioning a levee bag beneath the hopper.

25 Claims, 6 Drawing Sheets

PORTABLE LEVEE SYSTEM

CROSS-REFERENCE TO PRIOR APPLICATION

This Continuation-in-part application claims priority to U.S. patent application Ser. No. 09/621,425, filed on Jul. 21, 2000, now U.S. Pat. No. 6,390,154, which is incorporated herein by reference.

BACKGROUND OF THE INVENTION

1. Technical Field of the Invention

The present invention relates generally to a portable levee system. More particularly, the invention relates to a trailer mounted levee system for transfer of granular material into levee bags for forming levees in flood control systems.

2. Description of the Related Art

Sandbags have been used for many years in flood control. The use of typical sandbags is very labor intensive because sand, dirt, rocks, and the like are often scooped by handheld shovel means and deposited in sand bags which are manually held open.

Generally during flooding conditions, time is of the essence. As such, manual sandbag filling techniques may result in catastrophic losses since they are time consuming and generally very physically demanding. Some semi-automated sandbagging systems exist which may speed a process but they generally require manual handling of the sandbags once they are filled in order to form the levee.

For instance, various devices have been designed to expedite this time-consuming process. For instance, one invention uses a trailer mounted hopper having an auger disposed beneath the hopper to move sand placed in the hopper to a sandbag, one at a time. The bags must then be manually handled to form the levee.

Another device uses three augers disposed beneath a hopper. The hopper is mounted on a trailer which is mobile and the augers are driven by a combustion engine mounted on the trailer. Therefore the system is self-contained. The augers are driven by the combustion engine. When sand is dumped into the hopper, the augers force the sand to a spout where sandbags are positioned for filling. However, this process is also time-consuming because the bags must be handled by persons forming a levee and the bags are likely a small size due to the trailer design and necessity of human handling.

In view of the deficiencies in known sandbag filling devices, it is apparent that a portable levee system is needed for use with levee bags in order to form levees quickly, safely, and effectively for a plurality of uses wherein sandbags need not be manually handled during or after filling.

SUMMARY OF THE INVENTION

It is an object of the present invention to provide a portable levee system.

It is a further object of the present invention to provide a portable levee system having a bag loading apparatus for collapsible levee bags.

It is an even further object of the present invention to provide a system for continuous dispensing of a levee as the portable levee system moves.

Specifically, the present invention provides a portable levee system having continuous dispensing of levee bags comprising a lower frame and a hopper support frame extending from the lower frame. Wheels and tires are rotatably mounted along parallel sides of the lower frame and may be disposed either on an outer portion of the lower frame for bag filling or an inner portion for road travel. Extending between the lower frame and a hopper support frame are trusses and ribs providing strength and rigidity to the portable levee system. The hopper support frame supports a hopper and has a hopper adjustment assembly for raising and lowering the hopper to accommodate bags of various sizes. The hopper adjustment assembly may comprise either a rack and pinion crank or a hydraulic system. Beneath the hopper and depending from the hopper support frame are first and second bag rails. The bag rails are preferably formed of metal and have a first groove and a second groove extending through the bag rail below the first groove. The first groove is preferably circular in shape allowing a substantially spherical head of a bag guide to pass therethrough. Disposed throughout the bag rails are bag guides which allow a bag to be positioned beneath the hopper for filling. The bag guides maybe formed of nylon, polypropylene, or some other lightweight yet strong material being relatively inexpensive.

The hopper adjustment assembly may be used to manually or automatically raise or lower the hopper to allow bags of various sizes. In a first embodiment the hopper adjustment assembly uses a rack and pinion with a hand crank to raise and lower the hopper. In a second embodiment the hopper adjustment assembly uses a jack-screw which may be manually rotated causing linear motion of the hopper. In a third embodiment the hopper may be raised and lowered with a hydraulic system disposed on the portable levee system. The hopper support frame has a plurality of vertical support members having a plurality of adjustment holes spaced therein. A pin may be disposed through an adjustment hole to lock the hopper at a desired height.

The portable levee system further comprises a hitch at the front of the lower frame for connecting the portable levee system to a truck or other pulling device. The portable levee system also comprises a deck positioned near the front of the lower frame. The deck may be used as a base for the hydraulic system or for storage. Adjacent the deck may be a bag loading area wherein a large load of bags may be placed prior to loading onto the bag rails.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

The present invention will now be described in conjunction with the drawings, referring initially to FIG. 1, a portable levee system 10 is shown. The portable levee system 10 has a lower frame 12 being substantially U-shaped and formed preferably of steel. The steel may be square, round, channel shaped or some other structural shape.

Figure 2:
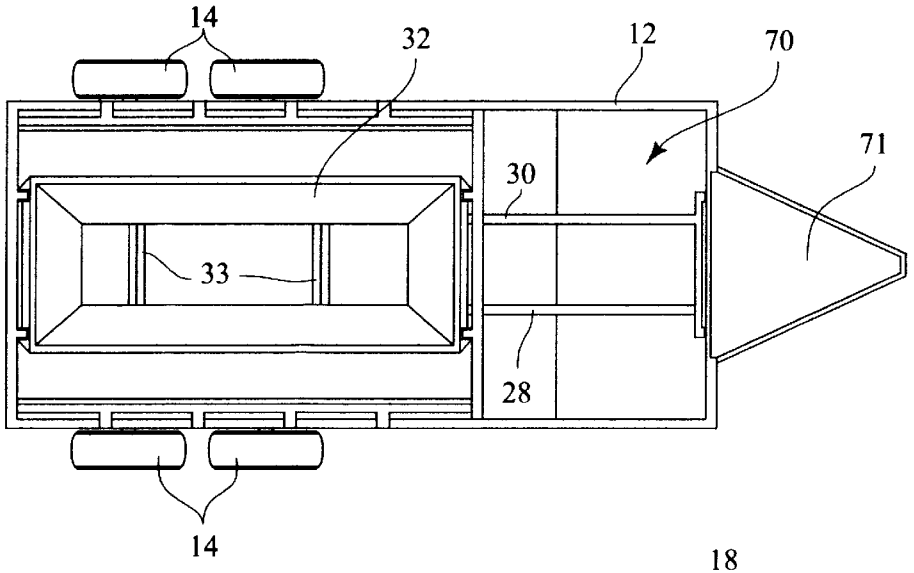
FIG. 2 shows a top view of the portable levee system of FIG. 1.
Figure 3:
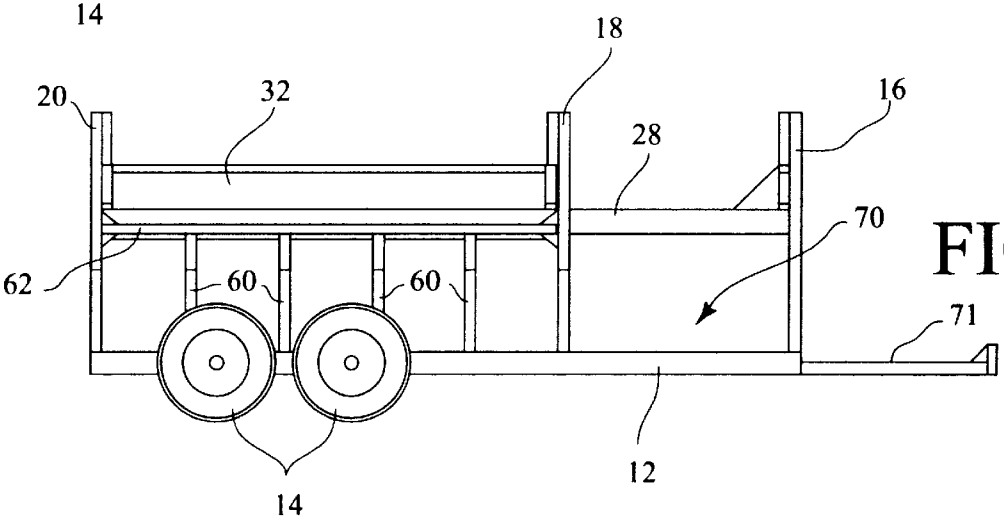
FIG. 3 shows a side view of the portable levee system of FIG. 1.

Extending from the lower frame 12 are a plurality of wheels assemblies 14 disposed along parallel sides of the portable levee system 10. The wheel assemblies are rotatably attached to the lower frame 12. As shown in FIGS. 1,2,3 the wheel assemblies 14 are mounted on an outer portion of the lower frame 12. The wheel assemblies 14 are preferably mounted on the outside of the lower frame 12 during formation of a levee. The wider wheel base provides greater stability during loading of the portable levee system 10 and out of contact with a levee bag during loading. However, when the portable levee system 10 is pulled over a roadway, the wheel assemblies 14 are preferably mounted inside the lower frame 12, as shown in phantom in FIG. 4.

Extending from the lower frame 12 to a hopper support frame 22 at a first end and a second end are hopper trusses 16,20. The hopper trusses 16,20 are substantially arched and support the hopper support frame 22. A third hopper truss 18 is disposed at a first end of a hopper 32. The trusses 16,18,20 provide structural support and stability for the portable levee system 10 and a means for mounting the hopper support frame 22 and the hopper 32.

Also extending from the lower frame 12 of the portable levee system 10 may be a plurality of ribs 60. The ribs 60 are connected to an upper structural member 62 extending between trusses 18,20. This design provides rigidity and strength to the portable levee system 10 preventing damage from the loading associated with the dirt, sand, and contact with any loading devices.

Figure 1:
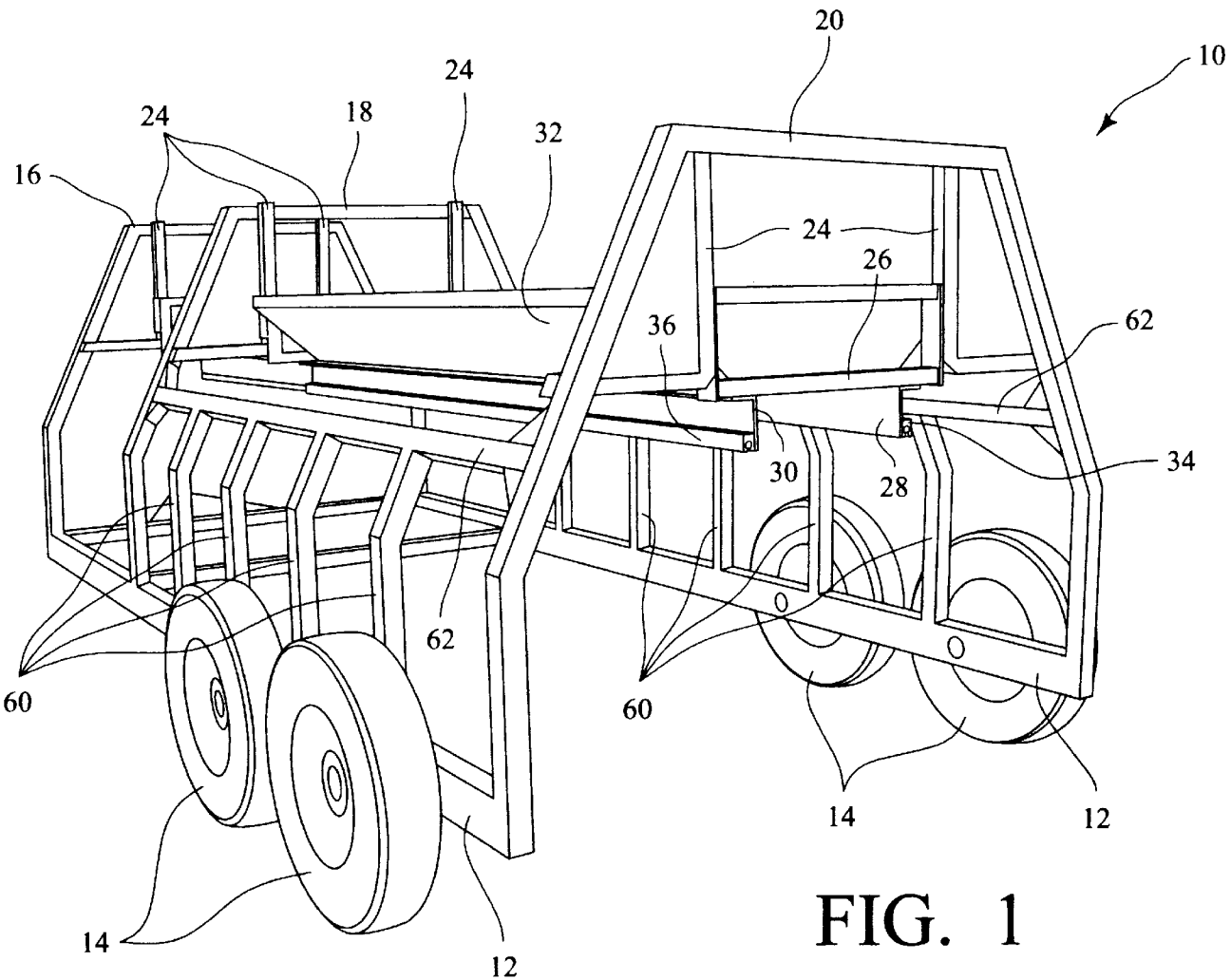
FIG. 1 shows a perspective view of the portable levee system of the present invention.
Figure 4:
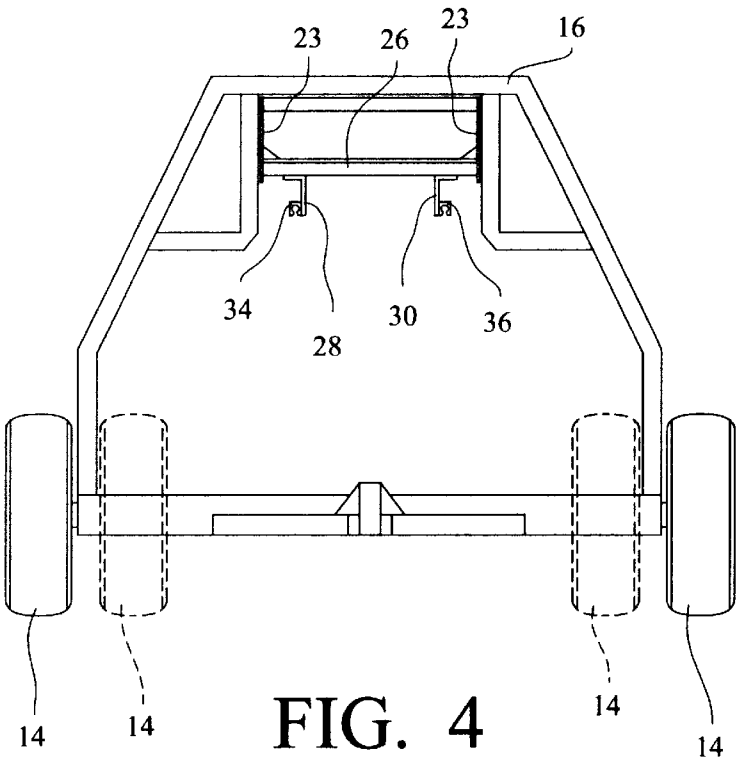
FIG. 4 shows an end view of the portable levee system of FIG. 1.
Figure 6:
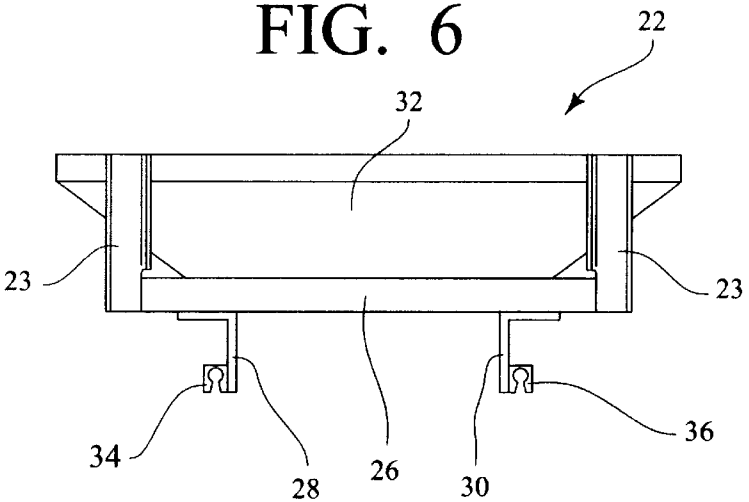
FIG. 6 shows an end view of the hopper support frame.
Figure 5:
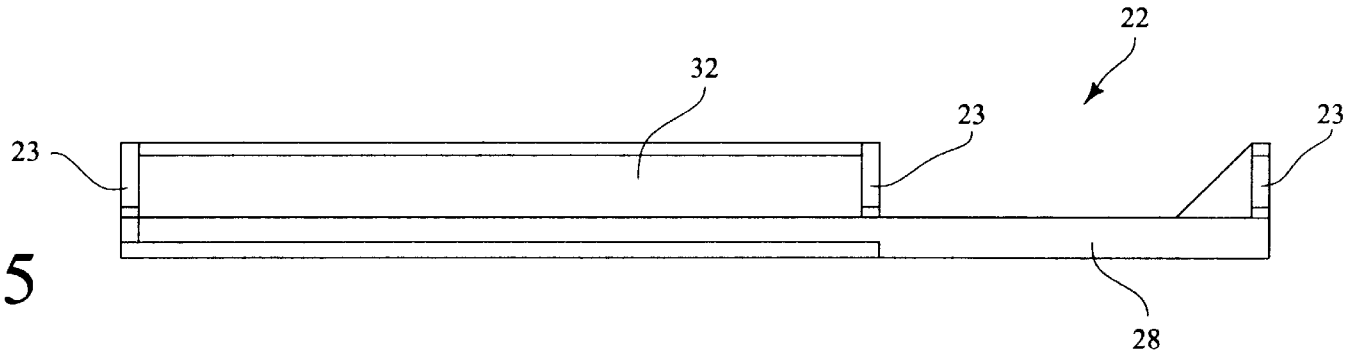
FIG. 5 shows a side view of the hopper support frame.

The hopper support frame 22 is comprised of a plurality of sliding support members 23, connecting members 26, and a first and a second hopper support beam 28,30, as seen in FIGS. 1,4,6. More specifically, depending from the hopper trusses 16,18,20 of FIG. 1 are vertical hopper support members 24. These members 24 are preferably square in cross section but may be any other structural shape known by one skilled in the art. The vertical hopper support members 24 are preferably spaced apart providing more stability for hopper 32 when the hopper 32 is loaded with sand, dirt, and the like. The sliding support members 23 are preferably U-shaped and disposed over the vertical hopper support members 24 slide thereon and allow vertical adjustment of hopper 32 height. Connecting the lower portions of the sliding support members 23 are connecting members 26. The connecting members 26 preferably have a square cross-section but may be any structural shape known to one skilled in the art.

Depending from the bottom of connecting members 26 and extending substantially the length of the portable levee system are first and second hopper support beams 28,30. The hopper support beams 28,30 preferably have a right angle shape, are formed of angle iron, and are aligned with and parallel to lower edges of the hopper 32. This configuration allows the beams 28,30 to support the hopper 32.

A second function of the hopper support beams 28,30 is to provide a structure from which first and second bag rails 34,36 may depend. The bag rails 34,36 are substantially rectangular in shape but may be various other shapes. As shown in FIGS. 4,6 the bag rails 34,36 are shown from an end view. The bag rails 34,36 have a first groove 38 which is preferably substantially circular in shape. The bag rails 34,36 also have a second groove or channel 40 extending from a bottom surface of the bag rail 34,36 to the first groove 38 wherein the second groove or channel 40 is smaller in size than the first groove 38. The bag rails 34,36 may be machined from a single piece of metal or from two pieces which are machined and fastened together. The bag rails 34,36 are preferably attached to a lower portion of the hopper support beams 28,30 as seen in FIGS. 4,6.

Figure 7:
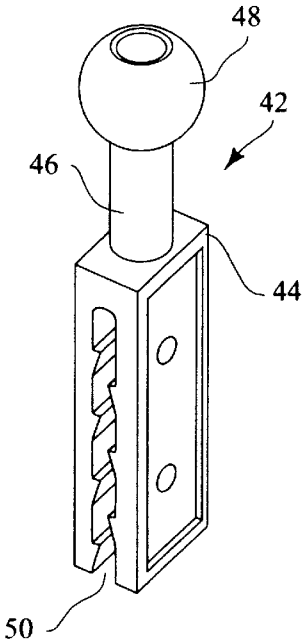
FIG. 7 shows a perspective view of a bag guide.
Figure 11:
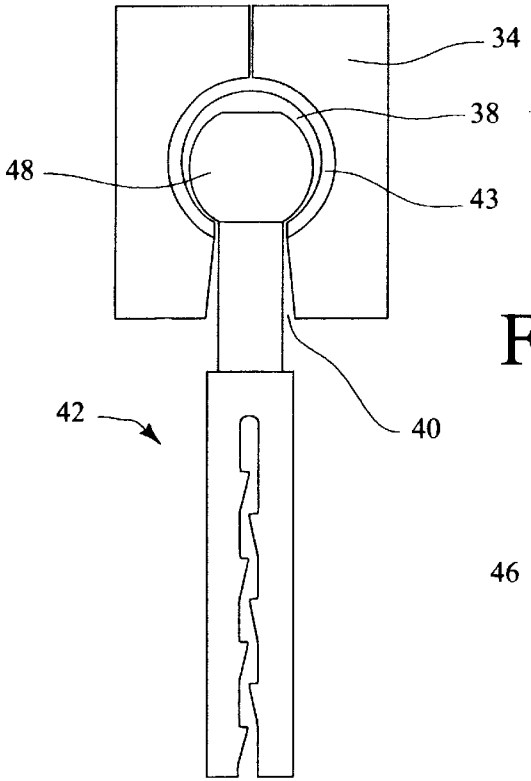
FIG. 11 shows an end view of the bag rail of the present invention.

Disposed within the bag rails 34,36, in a spaced configuration are bag guides 42, shown in FIG. 7. Each bag guide 42 has a body 44 which may be cylindrical or rectangular box shaped with a slot 50 disposed therethrough. The slot 50 allows a levee bag to be placed therein and the slot 50 may have teeth to grip and hold the bag in place. In addition, the body 44 has holes 47 disposed normal to the slot 50 wherein a fastener such as a screw or rivet may be placed to further support the levee bag in a hanging position.

The bag guide 42 further comprises a neck 46 extending from a top surface of the body 44. The neck is substantially cylindrical and has a head 48 disposed thereon. The head 48 is substantially spherical and is slightly smaller than the first groove 38 but larger than second groove 40. Thus the bag guide head 48 may be slidably disposed in the first groove 38 allowing sliding movement of the bag guide 42 through the bag rail. This also allows for continuous loading of bags and therefore continuous formation of levees.

Disposed above the hopper support frame 22 is hopper 32. As clearly shown in FIGS. 3,4 the hopper 32 is located above the hopper support beams 28,30 and necessarily above bag rails 34,36. The hopper 32 has an open upper end having a larger area than an open lower end. Since the upper end is larger than the lower end of hopper 32, the hopper walls are diagonally disposed. As dirt and sand is placed in the interior of the hopper 32 it feeds down the diagonally disposed walls to the open lower end where it may encounter structural members or sifting bars 33 shown in FIG. 2. The structural members 33 not only strengthen the hopper 32 but they break up clumps of sand and dirt and prevent blockage of the hopper 32 providing a smooth feed of dirt and sand to the levee bags depending from the bag rails 34,36. The structural members 33 are preferably formed of angle iron having a 90 degrees bend pointing upward in order to break clumps of sand and dirt. The hopper 32 may be constructed of steel and may also have abrasion resistant metal used as a liner for the interior surfaces of the hopper 32 to prevent premature wear.

Figure 8:
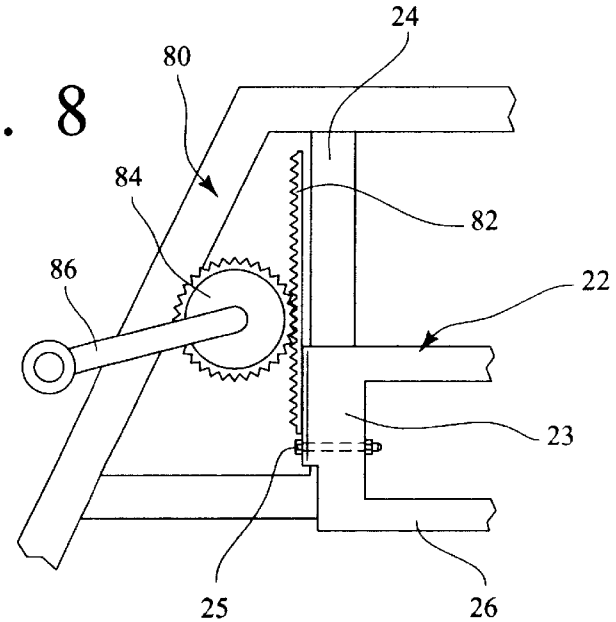
FIG. 8 shows a detail view of a crank assembly for raising and lowering the hopper.

The hopper 32 may be lifted in a plurality if ways. First, the hopper 32 may be lifted by forklift or front end loader to a desired height and locked into position with a pin or bolt 25 shown in FIG. 8. In a second method, as depicted in FIG. 8, a crank assembly 80 may be used to raise and lower the hopper 32 to a pre-selected height. The portable levee system 10 preferably has four crank assemblies 80, two attached to the hopper truss 20 and two attached to the hopper truss 16. The crank assembly 80 includes a rack 82 and pinion gear 84, and a handle 86 connected to the pinion gear 84. Two of the racks 82 are connected to the hopper support frame 22 which are slidably connected to the vertical hopper support members 24. At the front end of the portable levee system 10, the other two crank assemblies 80 may be connected to the hopper support frame 22 which is slidably connected to the vertical hopper support members 24 operably connected to the rack gear 82 may be the pinion gear 84 having a handle 86, which when turned causes the rack 82 and hopper support frame 22 to move vertically. When used in combination, the crank assemblies cause hopper support beams 28,30 to move vertically between a height of 24 to 80 inches. Once the desired height is obtained, the pin or bolt 25 is inserted through sliding support members 23 and vertical hopper support members 24.

Figure 12:
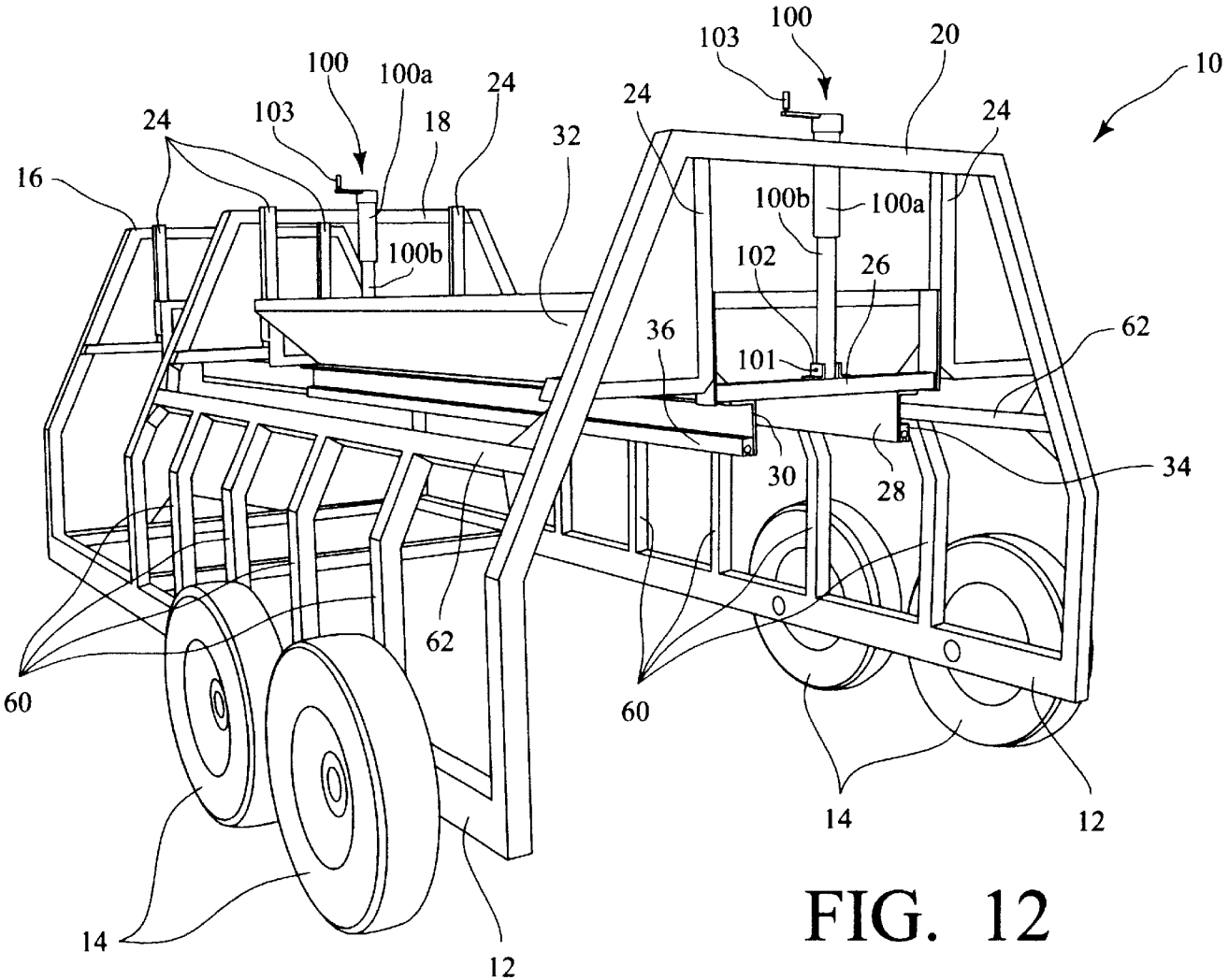
FIG. 12 shows a perspective view of the Portable Levee System having a jack screw assembly for raising and lowering the hopper.

A third and most preferable method of raising and lowering the hopper 32 to a pre-selected height is with a manually operated jack screw 100, as shown in FIG. 12. In accordance with this embodiment, the jack screw 100 has an upper portion 100*a* and a lower portion 100*b* which slides relative to the and within upper portion 100*a*. The upper and lower portions 100*a*,100*b* have cylindrical housing shapes. The portable levee system 10 most preferably has first and second jack-screws 100 fixably connected to the upper sections of trusses 18,20 at the hopper 32 ends. At lower ends of the jack screws 100, are pins or bolts 101 which extend through the jack screws 100 and through brackets 102 connecting the jack screw 100 to the connecting members 26 of hopper frame 22. Extending through the upper and lower portions of jack screw 100*a*,100*b* is a threaded rod. Within the lower portion 100*b* of jack screw 100 is a nut which is threadably connected to the threaded rod. A handle 103 is fixedly attached to the upper portion of the threaded rod so that when the handle 103 is rotated the nut moves along the threaded rod thus raising or lowering the hopper 32.

Figure 9:
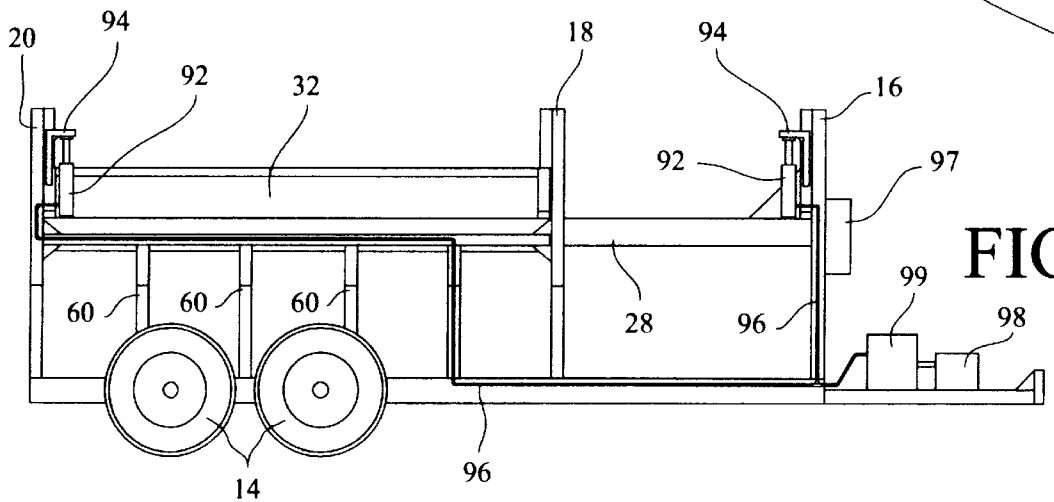
FIG. 9 shows a side view of a portable levee system having a hydraulically adjustable hopper.

A fourth method of raising and lowering the hopper 32 is with a hydraulic system 90. As shown in FIG. 9 hydraulic cylinders 92 may be disposed at first and second ends of hopper support beams 28,30 with hydraulic pistons connected to brackets 94. The hydraulic fluid lines 96 are routed over the portable levee system 10 along the frame and are connected to the hydraulic cylinders 92 at a first end and a hydraulic pump 98 and reservoir 99 at a second end. The hydraulic pump 98, reservoir 99, and a control panel 97 may be positioned near a front deck 71. A generator may also be installed on the deck 71 or power for the hydraulic system 90 may be obtained from remote power supplies.

At a front portion of the portable levee system 10, beneath the hopper support beams 28,30 and adjacent the truss 16, is a bag loading area 70. The bag loading area 70 is where boxes of bags may be disposed for use with the portable levee system 10. The bag loading area 70 preferably has enough space for bags to be removed from boxes and loaded onto the bag rails 34,36.

In use, the portable levee machine is connected by hitch 74 to a truck, tractor, or other pulling machine. A plurality of bag boxes are preferably disposed in the bag loading area 70. Bags are removed from the boxes, preferably having the bag guides 42 attached thereto, and loaded onto the portable levee system to begin forming a levee. More specifically, the bags are preferably loaded in either of two ways. First, the bags may be loaded by sliding each of the bag guides 42 into bag rails 34,36. This is a time consuming and more labor intensive method of loading.

Figure 10:
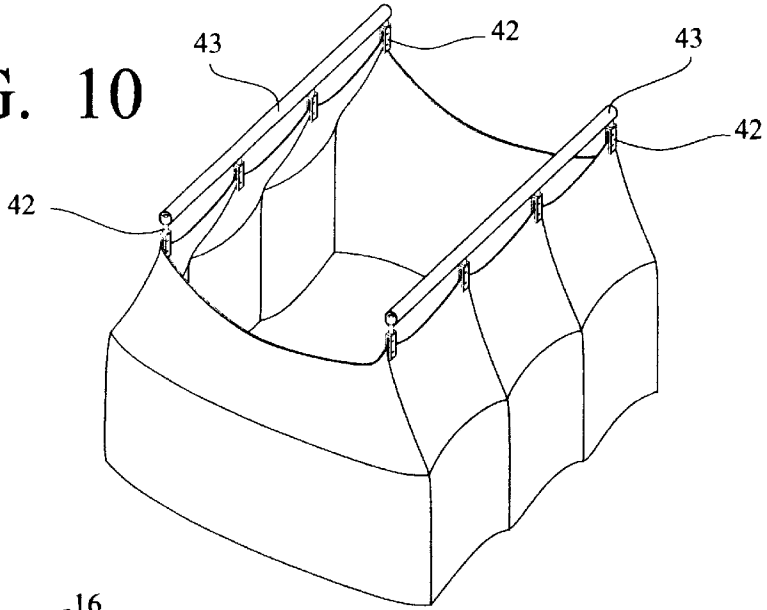
FIG. 10 shows a perspective view of a bag guide loading track having bag guides loaded therein.

In a second method of loading the bags, the bag guides 42 preferably come preloaded into a bag guide loading track 43, as shown in FIG. 10. The bag guide loading track 43 is preferably formed of PVC, polypropylene, or the like and has a hollow cylindrical shape with a slit or gap extending the length of the track 43. The bag guide loading track 43 preferably has an outer diameter slightly less than the diameter of the first groove 38. The bag guide loading track 43 has an inner diameter slightly greater than the head 48 of the bag guides 42 such that the bag guides 42 may be disposed therein. The length of the bag guide loading track 43 may vary depending on the size of the bag used in forming the levee. In order to expedite loading of the bag guides 42, the bag loading track 43 may be slidably disposed in the first groove 38 of the bag rails 34,36. This structure negates the loading of each bag guide separately and allows fast loading of an entire bag. Moreover, it makes continuous feeding of the bags more plausible and less time consuming. Another advantage of the present invention is that the levee bags are manually handled only when they empty. This is safer and faster than prior systems which require manual handling of bags after they have been filled.

In either method, the bag is loaded onto the portable levee system 10 and extended beneath the entire length of the hopper 32. The bottom of the levee bag preferably contacts the substrate therebeneath to facilitate best use of the portable levee system 10. Once the bag is extended, loading of the hopper 32 begins. The hopper 32 may be loaded by front end loader, by auger, by a hydraulically controlled bucket and arm mounted to the portable levee system 10, or some other means known in the art. The dirt or sand is scooped into the hopper 32 which directs the fill material to the bag therebeneath.

As the first bag is being filled, a second bag is loaded onto the bag rails 34,36. When the first bag is filled, the tractor, truck, or pulling device advances forward. The weight of the sand and dirt maintains the bags in its position relative to the substrate earth, beneath. As the portable levee system 10 continues forward the first bag slides out of the bag rails 34,36 and the second bag may be slidably extended into filling position beneath the hopper 32. The bags may have a grasping mechanism to interconnect the bags. Thus, as a first bag slides from the portable levee system, the second bag is automatically pulled into position beneath the hopper 32. As the second bag is filled with sand, dirt, and the like, a third bag is loaded onto bag rails 34,36. This process continues until a desirable length of levee is formed.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A portable levee system, comprising:

a substantially U-shaped lower frame;

a hopper truss extending from said lower frame and having a plurality of vertical hopper support members depending therefrom;

a hopper supported by a hopper support frame, said hopper support frame slidably connected to said vertical hopper support members;

a bag rail depending from said hopper support frame; and, a bag loading area.

2. The portable levee system of claim 1, further comprising wheels on parallel sides of said lower frame.

3. The portable levee system of claim 1, further comprising a hopper crank assembly.

4. The portable levee system of claim 3, said hopper crank assembly including a rack gear, a pinion gear, and crank.

5. The portable levee system of claim 1 further comprising a hydraulic system operably connected to said hopper.

6. The portable levee system of claim 1 further comprising a jack screw operably connecting said hopper support frame and said hopper truss.

7. The portable levee system of claim 6, said hopper support frame having a plurality of adjustment apertures.

8. The portable levee system of claim 7, said vertical hopper support members having adjustment apertures.

9. The portable levee system of claim 8, further comprising locking pins extending through said vertical hopper support members and said hopper support frame.

10. The portable levee system of claim 1, said bag rail having a circular first groove and a second groove disposed beneath said first groove.

11. The portable levee system of claim 1, further comprising a bag guide slidably disposed within said bag rail.

12. The portable levee system of claim 1 said bag guide having a body, a neck extending from said body, and a head disposed on said neck.

13. The portable levee system of claim 12 said bag guide body having a plurality of holes extending therethrough.

14. The portable levee system of claim 1, further comprising a bag guide disposed in said bag rail.

15. A portable levee system, comprising:

a lower frame structure having wheels extending from said lower frame;

a hopper truss extending from said lower frame;

a hopper supported by a hopper support frame, said hopper support frame slidably engaging hopper support members;

first and second bag rails depending from said hopper support frame, said first and second bag rails adjacent a bottom portion of said hopper; and, a plurality of bag guides slidably disposed in said first and second bag rails.

16. The portable levee system of claim 15, further comprising an adjustment assembly comprising a crank operably connected to a rack and pinion.

17. The portable levee system of claim 15 further comprising a jack screw extending between said hopper truss and said hopper support frame.

18. The portable levee system of claim 15, said first and second bag rails having a circular first groove and a second groove below above said first groove.

19. The portable levee system of claim 18 further comprising a plurality of bag guides slidably disposed in said bag rails.

20. The portable levee system of claim 15 further comprising a bag loading area.

21. The portable levee system of claim 15 further comprising a hydraulic system operably connected to said hopper support frame.

22. A portable levee system, comprising:

a hopper truss extending from a lower frame;

said lower frame having wheels disposed along parallel sides;

first and second bag rails depending from a hopper support frame;

a hopper supported by said hopper support frame, said hopper support frame slidably connected to a vertical hopper support member depending from said hopper truss;

at least one structural member extending across said hopper;

a deck and a hitch extending from a front portion of the portable levee system;

a bag loading area adjacent said bag rails;

a plurality of wheels rotatably mounted to said lower frame.

23. The portable levee system of claim 22, said hopper support frame further comprising first and second hopper support beams substantially extending the length of said portable levee system.

24. The portable levee system of claim 22, said hopper support frame further comprising a plurality of sliding support members slidably connected to said vertical hopper support members.

25. The portable levee system of claim 22 further comprising a hydraulic system connected to said hopper support frame.

* * * * *